United States Patent [19]

Sanderson

[11] Patent Number: 5,036,553

[45] Date of Patent: Aug. 6, 1991

[54] FULLY AUTOMATIC TOILET SYSTEM

[76] Inventor: Dilworth D. Sanderson, 58 Rosemont Blvd., White Plains, N.Y. 10607

[21] Appl. No.: 543,430

[22] Filed: Jun. 26, 1990

[51] Int. Cl.[5] ..... E03D 1/14

[52] U.S. Cl. ..... 4/313; 4/324; 4/333; 4/406; 4/DIG. 3

[58] Field of Search ..... 4/300, 302, 304, 305, 4/313, 324, 325, 333, 366, 405, 406, 415, DIG. 3; 417/40, 41; 137/386, 392

[56] References Cited

U.S. PATENT DOCUMENTS

| | | | |
|---|---|---|---|
| 3,908,204 | 9/1975 | Hopkins | 4/324 X |
| 4,080,669 | 3/1978 | Biggerstaff | 4/325 |
| 4,310,934 | 1/1982 | Hennessy et al. | 4/321 |
| 4,392,260 | 7/1983 | Bensen | 4/324 |
| 4,407,025 | 10/1983 | Hennessy et al. | 4/415 X |
| 4,908,886 | 3/1990 | Barrett, Sr. et al. | 4/325 |

FOREIGN PATENT DOCUMENTS

| | | | |
|---|---|---|---|
| 3640216 | 5/1988 | Fed. Rep. of Germany | 4/305 |
| 2615014 | 11/1988 | France | 4/305 |

*Primary Examiner*—Henry J. Recla
*Assistant Examiner*—Robert M. Fetsuga
*Attorney, Agent, or Firm*—Terry M. Gernstein

[57] ABSTRACT

A toilet includes a toilet bowl fluidically connected to a water storage tank. A control circuit is mounted on the storage tank and a water level sensor circuit is mounted on the bowl. A control panel is manually set to set the amount of water used in a flush cycle, and a fluid pump is used to move water from a source to the storage tank and to the bowl. Operation of the fluid pump is controlled by the water sensing circuit in the storage tank and the water level sensing circuit in the bowl. A solenoid-like plunger is used to control opening and closing of an outlet valve in the storage tank.

14 Claims, 6 Drawing Sheets

FULLY AUTOMATIC TOILET SYSTEM

TECHNICAL FIELD OF THE INVENTION

The present invention relates to the general art of water closets, and to the particular field of flush and flush control systems for water closets.

BACKGROUND OF THE INVENTION

Toilets and the flush mechanisms therefor have become highly standardized, and generally include a bowl through which water passes to receive and remove matter, and a water storage tank fluidically connected to that bowl to replenish water in the bowl after the flushing has emptied the bowl.

There have been several variations in this standard mechanism to achieve several different objects. For example, some toilets are sized to be accommodated in small areas such as might be found in airplanes, busses, and the like. Other flush mechanisms have been designed to conserve water, while other mechanisms have been designed to remove odors as well as water from the toilet.

While successful, the known toilets and flush mechanisms still have several drawbacks. For example, many of these systems depend on water pressure to operate the seal used in the storage tank to occlude the inlet port to a conduit connecting that storage tank to the bowl. After some period of use, such seals tend to degrade, and water pressure alone may not be sufficient to prevent leakage. A further drawback is associated with the mechanical controls of many toilets and their flush mechanisms. Such mechanical controls are not as accurate as may be desired and can tend to degrade after a period of use thereby further lowering the accuracy thereof. For example, if it is desired to fill the storage tank only one-half full, this filling can vary from flush to flush and can seriously undermine the intent of such limited filling.

Still further, many previous toilets, especially ones with mechanical controls, cannot have the flush cycle interrupted or stopped once it has been initiated. Once begun, the flush cycle must be completed. This can be wasteful of water, and a single unwanted flush can vitiate much of the water savings achieved by using only a partially filled water storage tank.

Therefore, there is a need for a fully automatic toilet and flush system in which the amount of water used can be precisely controlled and which is not as susceptible to damage-related inaccuracies as are prior toilets and toilet flush mechanisms.

OBJECTS OF THE INVENTION

It is a main object of the present invention is to provide a fully automatic toilet and flush system.

It is another object of the present invention to provide a fully automatic toilet and flush system in which the amount of water used can be precisely controlled.

It is another object of the present invention to provide a fully automatic toilet and flush system in which the amount of water used can be precisely controlled and which is not as susceptible to damage-related inaccuracies as are prior toilets and toilet flush mechanisms.

SUMMARY OF THE INVENTION

These, and other, objects are achieved by a toilet which includes a flush mechanism that is operated by a pump, which, in turn, is controlled by electronic water level sensing circuits mounted in the toilet bowl and in the water storage tank.

The control circuitry includes a delay circuit which controls a relay that moves between an open and a closed position, and moves each time power is applied thereto. The delay circuit is activated by a water level sensing circuit, and the water level sensing circuit is controlled and set by a user via a manual control panel mounted on top of the water storage tank. A spring-biased solenoid-like valve element is connected to a power source via the relay, and is opened when the relay closes to complete a circuit between the valve element and the power source. The valve element closes under influence of the spring biasing when the relay is opened and power is removed from the valve element.

The pump is activated and the relay is opened according to signals from the water level sensing means mounted in the storage tank when the water level in the water storage tank reaches a pre-set low level, and the re-activated pump fills the toilet bowl to a pre-set level. A water level sensing circuit in the bowl shuts off the pump when the water level in the bowl reaches the pre-set fill level. Once the water level in the storage tank reaches the pre-set fill level, a delay circuit is activated, and after a predetermined delay, the power is applied to the relay to connect the valve element to the power source and move the valve element away from the outlet of the storage tank thus releasing the water from the storage tank into the system that will flush water from the toilet bowl, such as a syphon system or the like.

Once the water level in the storage tank reaches the pre-set low level, a signal is sent to a bowl-mounted water level sensing circuit which then applies power to the fluid pump to reactivate same, and to a normally closed solenoid-operated valve to open that valve so water moving from the fluid pump is directed into the toilet bowl. The normally closed solenoid-controlled valve is biased to close unless power is applied thereto, and opens as soon as power is applied thereto. The bowl-mounted water level sensing circuit removes power from both the fluid pump and from the solenoid-controlled valve as soon as water in the toilet bowl reaches a pre-set level.

The control panel includes an override circuit which is manually activated by a "hold" button to temporarily stop the pump and thus interrupt the flush cycle. The pump is manually restarted by activating a "go" button on the control panel to restart the flush cycle. The control panel also can include a reset system which shuts the fluid pump down until the storage tank outlet port is closed.

BRIEF DESCRIPTION OF THE DRAWING FIGURES

DETAILED DESCRIPTION OF THE PREFERRED EMBODIMENT OF THE INVENTION

Figure 1:
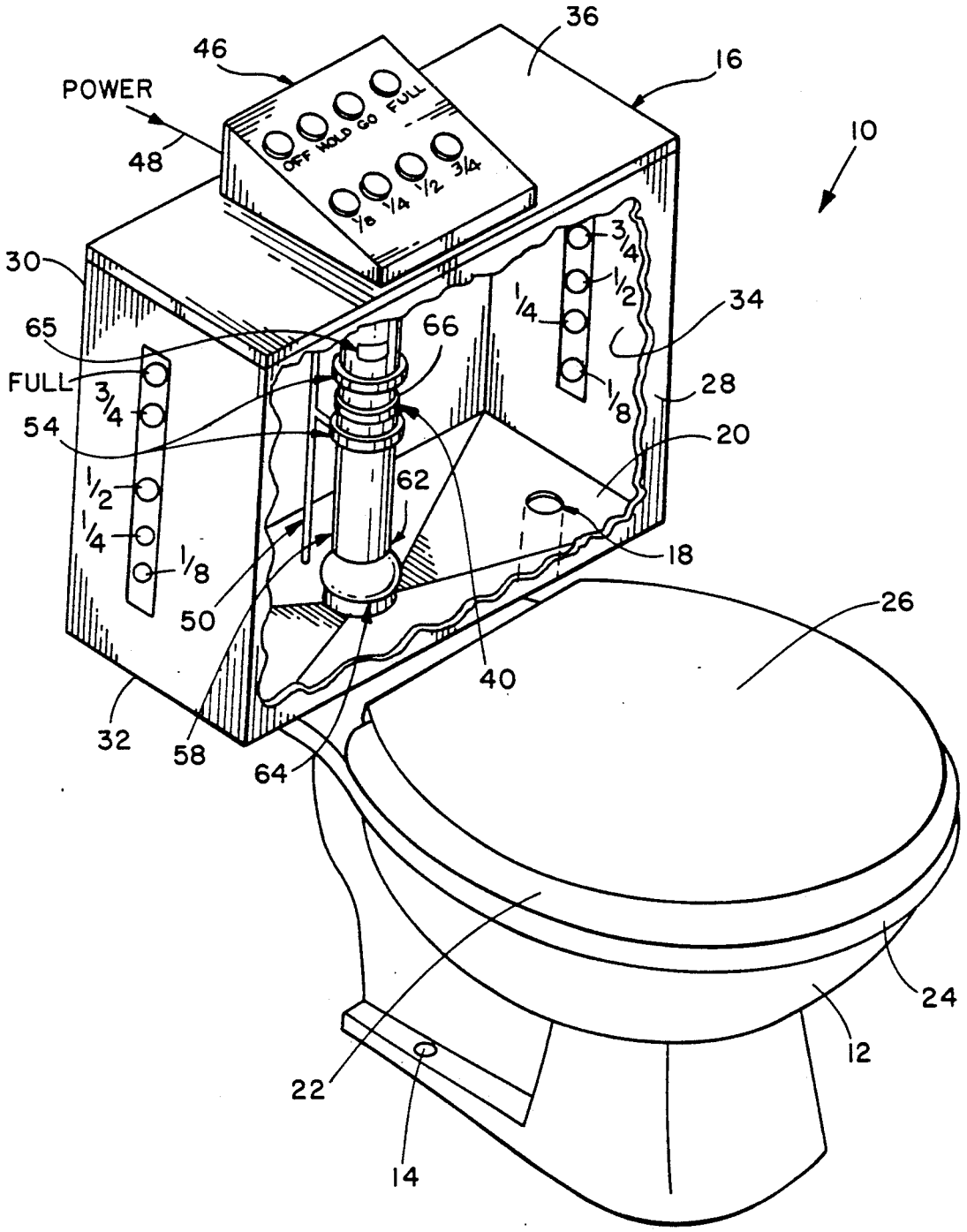
FIG. 1 is a perspective view of a toilet having a toilet bowl and a water storage tank and which embodies the present invention.

Shown in FIG. 1 is a toilet 10 embodying the present invention. The toilet 10 includes a toilet bowl 12 mounted on a support surface, such as a floor, by bolts covered by bolt caps 14, and on which a water storage tank 16 is mounted. Water is supplied to the water storage tank from a utility system or the like via an inlet port 18 defined in a bottom wall 20 of the water storage tank. This water is used to execute the flushing cycle of the toilet bowl, such as by establishing a syphon action associated with the flushing of the toilet, to remove water and matter from the bowl 12.

The bowl 12 includes the usual seat 22 supported on a rim 24 and which supports a cover 26 both of which are hingeably attached to the bowl in the usual manner. The bowl is fluidically connected to a sewage disposal system as is common to such toilets.

Figure 2:
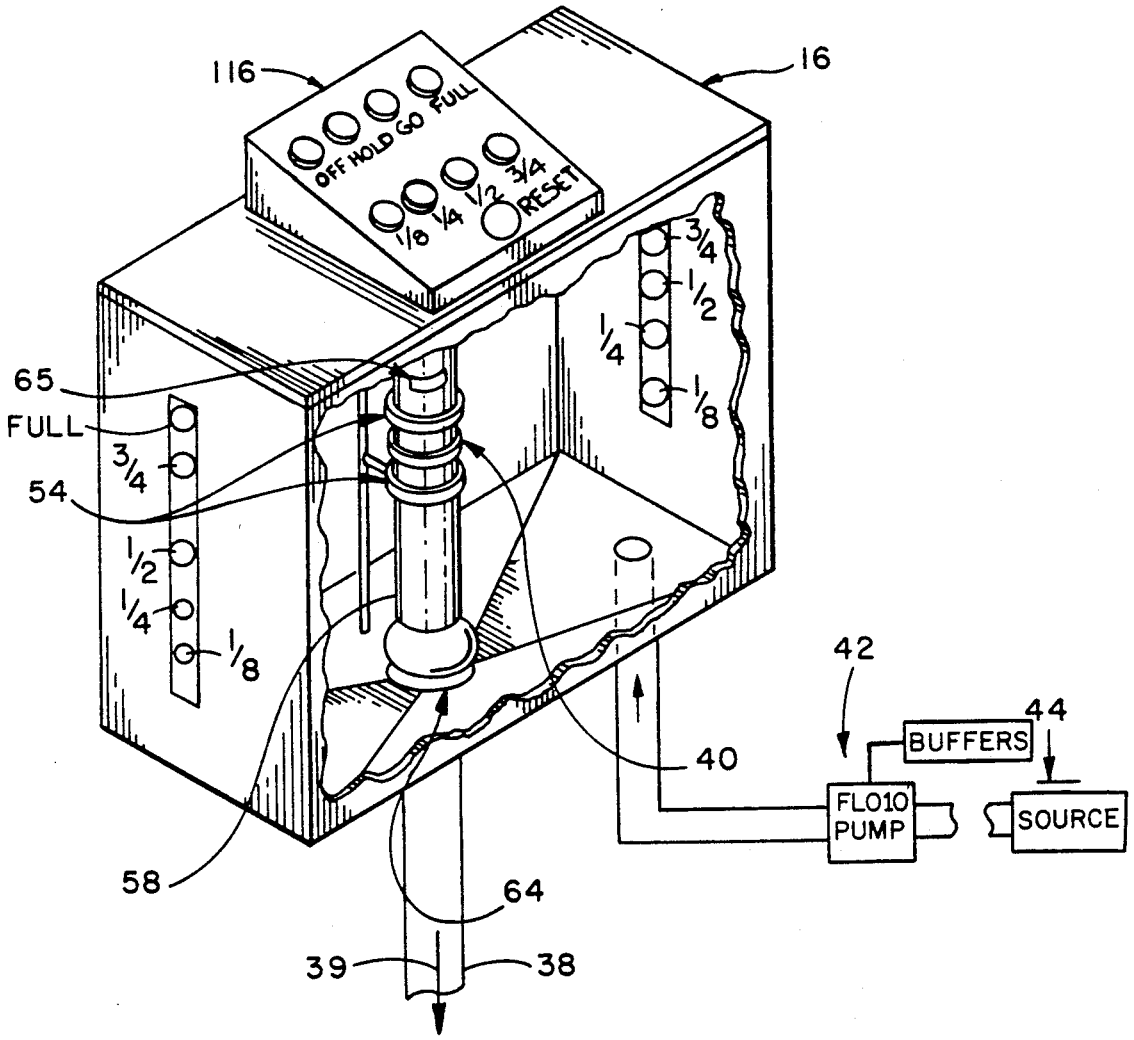
FIG. 2 is a perspective view of the water storage tank with part of a front wall removed to expose the interior of that tank.

As is best shown in FIGS. 1 and 2, the storage tank 16 includes a front wall 28, a rear wall 30 and two side walls 32 and 34 all connected to and extending upwardly from the bottom wall 20. A top wall 36 rests on the side, rear and front walls to define a water storage chamber in the water storage tank. The bottom wall slopes from the side, rear and front walls toward the center of that bottom wall, and an outlet port is defined in the center of the bottom wall so that the bottom wall slopes towards such outlet port. This ensures that all of the water in the storage tank will be biased towards the outlet port. Water flows from the storage tank out of the outlet port and to the toilet bowl via a conduit 38 during the flush cycle as indicated by arrow 39, and flows into the storage tank via the inlet port 18 to replenish the supply of water in the storage tank.

The flush mechanism of the present invention includes a valve means 40 which opens and occludes the water storage tank outlet port, a fluid pump 42 moves water from a source 44 to and through the flush system of the toilet 10, and a control system is mounted on the water storage tank and on the toilet bowl to control operation of the flush system based on the level of water in the storage tank and in the toilet bowl. A manual control panel 46 is mounted on top of the water storage tank top wall and is manually operated by a user to control, initiate, and interrupt the flush cycle.

As is best shown in FIGS. 1 and 2, the control panel is powered from utility power via a line conductor 48 and distributes this power as necessary to the various components of the flush system. This control panel includes a plurality of manually operated buttons, such as an "on" button which is used to initiate the flush cycle, a "hold" button which is used to interrupt the flush cycle if desired, a "go" button which is used to re-start the flush cycle after interruption using the "hold" button, and several level-selecting buttons, such as "full", "$\frac{1}{8}$", "$\frac{1}{4}$", "$\frac{1}{2}$" and "$\frac{3}{4}$" which are used to set the amount of water used in a particular flush cycle. Each of these level-setting buttons sets the level to which the water storage tank is filled. For example, the tank will be filled to $\frac{3}{4}$ capacity if the "$\frac{3}{4}$" button is operated in conjunction with the "on" button, so the flush cycle will use only $\frac{3}{4}$ of the total water capacity of the water storage tank. The amount of water used in any particular flush cycle can be precisely controlled using the control panel. A reset button is also included on the panel 46.

Figure 5:
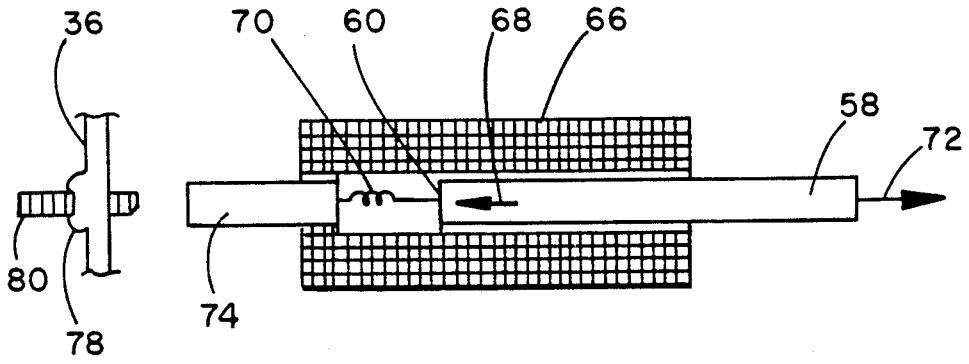
FIG. 5 illustrates a valve means which is operated to open and close the outlet port of the water storage tank.

As best shown in FIGS. 1, 2 and 5, the flush mechanism of the present invention includes valve assembly 40 which opens and closes the water outlet port of the water storage tank in a precise manner and which is not susceptible to water damage and leaking due to such water damage.

The valve assembly 40 includes a support element 50 mounted on the water storage tank bottom and inner surface of the tank rear wall. This support element 50 includes a standard 52 extending upwardly from the tank bottom wall inner surface towards the top wall, and a plurality of rings 54 attached thereto by arms, such as arm 56, which extend towards the front wall of the tank. The rings are circular and are located to have their centers aligned with each other and with the center of the water outlet port.

A hollow magnetic plunger element 58 is movably supported in the rings to move up towards the tank top wall and down towards the tank bottom wall. The plunger element includes a top end 60 (not visible in FIGS. 1 and 2) and a bottom end 62 having a sealing element 64 mounted thereon. This sealing element is preferably formed of elastomeric material, and is sized to totally cover the water outlet port of the tank to prevent any water from flowing out of the tank via the outlet port when the sealing element is in position covering that port, as shown in FIGS. 1 and 2. The plunger is adapted to move from a first position having the sealing element covering the outlet port to a second position having the sealing element spaced towards the tank top wall and spaced from the outlet port far enough to permit water from the storage tank to flow out of the outlet port and to fluidically connect the water storage tank to the toilet bowl. An overflow port 65 is defined in the plunger near the top end thereof so water from the storage tank can flow into the flush system in an overflow condition.

The plunger is magnetic and is moved by a plunger moving means which includes a solenoid coil 66 which is wrapped around the plunger in a direction to move the plunger upwardly towards the tank top wall in the direction indicated by arrow 68 in FIG. 5 when power is applied to the coil 66.

The plunger moves into position with the sealing element spaced from the tank outlet port when power is applied to the coil. A compression spring 70 biases the plunger toward the tank bottom wall in the direction indicated by arrow 72, and moves the plunger in such direction 72 when power is not being applied to the coil 66. The spring 70 is connected at one end thereof to the top of the plunger and at the other end thereof to a stop element 74 that is mounted on the tank top wall 36. The stop element includes a screw thread which is threadably engaged with a nut 78 fixed to the tank top wall so the location of the stop element forward end can be adjusted with respect to the tank top wall. The location of the stop element forward end sets the location to which the plunger moves when it moves to its second position spaced from the tank outlet port and also sets the amount of force which resists movement of the plunger as determined by the spring. The stop element preferably includes a slot in the top 80 thereof so a blade screwdriver can be used to set the position of the stop element.

Figure 3:
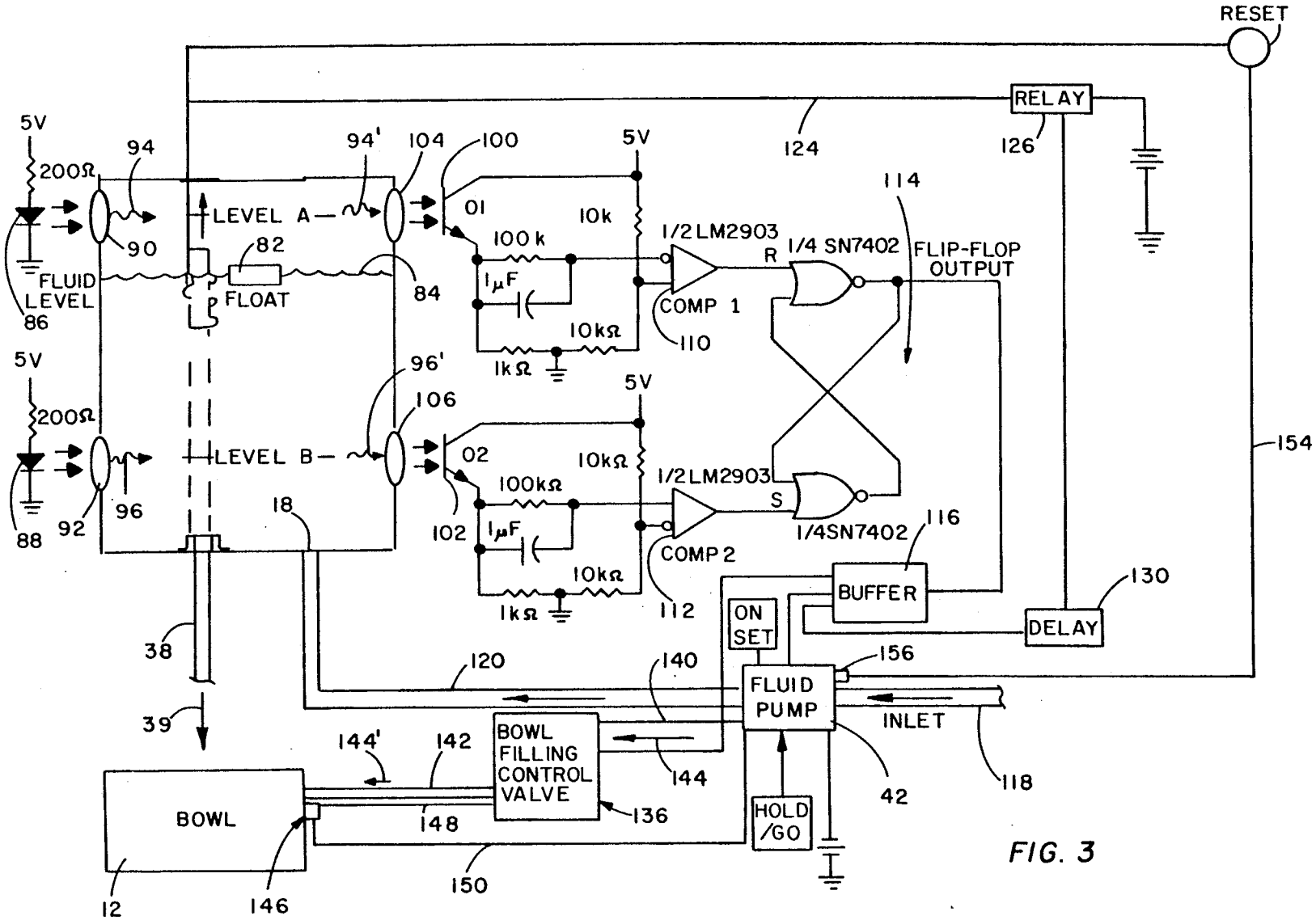
FIG. 3 is a circuit diagram illustrating a water level sensing control system for the flush system.

The control means used to control operation and sequencing of the flush operation is shown in FIGS. 1, 2 and 3. The control means includes an opaque float 82 that rests on top of the water in the tank and moves with the water level, indicated at reference number 84. The control means also includes a plurality of light emitting elements, such as elements 86 and 88 shown in FIG. 3 mounted on the inside surface of one of the tank side walls and having a cover and a focusing lens mounted on the cover, such as lenses 90 and 92. When activated, the light emitting elements emit light, indicated by arrows 94 and 96 in FIG. 3. Each of the light emitting elements is connected to the power source via an associated one of the control buttons on the control panel so that one of the light emitting elements is activated to emit a light ray when a particular button is depressed. For example, FIG. 3 illustrates two light emitting elements as being located at levels A and B, which could, for example, be the "full" level and the "⅛" level. In the ensuing discussion, these two elements will be used as an example of a flush operation, but it is to be understood that these elements are being used as examples only, and no limitation is intended. Thus, the exemplary flush operation will use a "full" tank choice, but could be other levels if desired and suitable. The lowermost light element is always activated to emit a light ray for each flush cycle, and the user selects the top light emitting element to be used in conjunction with such lowermost light emitting element.

A plurality of light sensing elements, such as light sensing elements 100 and 102 are mounted on the other tank side wall to be co-level with corresponding ones of the light emitting elements to receive light emitted by such light emitting elements when such elements are activated. Each of the light sensing elements is located inside the tank and includes a cover having a lens, such as lenses 104 and 106, mounted in the cover to focus incident light onto the light sensing element in the cover. Such incident light is indicated as rays 94' and 96' in FIG. 3.

Each of the light sensing elements emits a signal in accordance with the light rays emitted by the light emitting elements and the interruption thereof by the float moving into the path of the light rays as the liquid level 84 changes during a flush cycle, and such signals are processed in comparators, such as comparators 110 and 112 and the outputs thereof applied to a flip-flop circuit 114 and then to a buffer element 116. Upon receiving a signal from the flip-flop circuit, the buffer element 116 generates a corresponding signal. The signal from the buffer element is applied to the fluid pump 42 to actuate same or to shut such pump down depending on the signal received from the buffer element.

Thus, when fluid is at level B (tank is ⅛ full), manual actuation of the system starts the pump 42. The pump 42 transfers water from source 44 via inlet line 118 into the water tank 16 via inlet conduit 120 which is attached to the tank inlet port 18.

With the plunger 58 covering the tank outlet port, the tank fills under the influence of this inflowing water. As the tank fills, water level 84 rises toward level A (tank is full). As soon as the float breaks the light beam 94, the light sensing element 100 emits a signal which is processed to turn the pump off. By selecting the tank fill level using the control panel, the amount of water used in each flush operation can be precisely controlled.

The flush operation is continued as the plunger 58 is automatically moved away from the tank outlet port to release the water from the tank into the system being used to flush the bowl 12. This automatic movement of the plunger 58 is achieved by applying power to the coil 66 surrounding such plunger. Power is applied to the coil via a line conductor 124 that is connected at one end thereof to a relay 126 and at the other end thereof to the coil 66. The relay is connected to the power source.

The relay is a two position relay and moves from one position to the other every time power is applied thereto. Thus, if the relay is open, and power is applied thereto, the relay will close, and once closed, will remain closed until power is again applied thereto at which time the relay opens.

Figure 4:
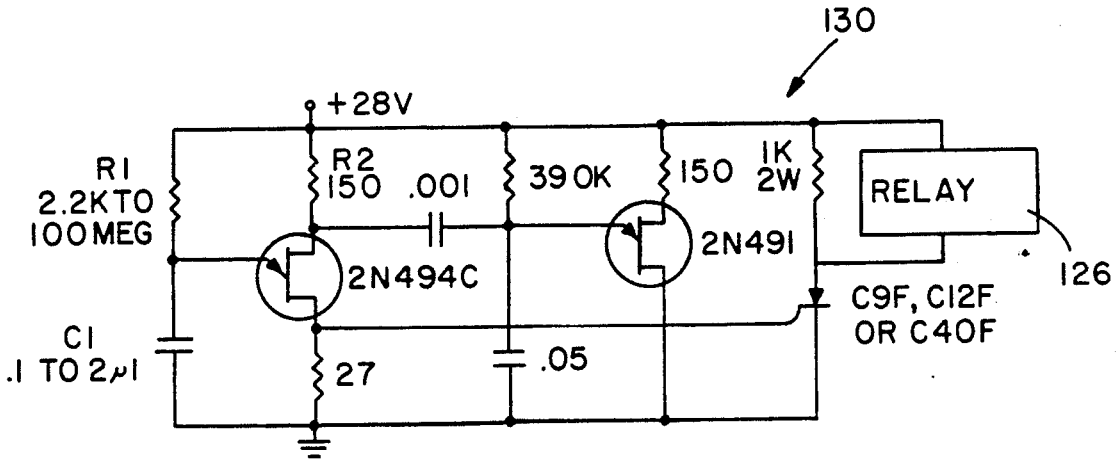
FIG. 4 is a circuit diagram illustrating a delay circuit which is used in conjunction with the water level sensing control system to actuate a water outlet port closing valve after a pump has been shut down to permit water to move from the storage tank into the syphon system associated with the toilet bowl.

Power is applied to the relay via a delay circuit 130, shown in FIGS. 3 and 4. Time delays from 0.3 milliseconds to over three minutes are possible using the circuit 130. The timing interval is initiated by applying power from the buffer element 116 to the circuit 130. At the end of the timing interval, which is determined by the value of R1C1, the 2N494C fires the controlled rectifier. This places the supply voltage minus about one volt across the relay 126. Relay currents are limited only by the rating of the controlled rectifier which can be from 1 ampere up to 25 amperes. A calibrated potentiometer can be used in place of R1 to permit setting a predetermined time delay after one initial calibration.

Thus, once the float reaches the predetermined level, such as level A, the buffer shuts off the pump, and applies power to the delay circuit. After a preset delay, the delay circuit applies power to the relay 126 which closes the relay to apply power to the coil 66. Once power is applied to the coil 66, the plunger 58 is lifted to move the sealing element from covering relationship with the tank outlet port, and the water from the tank is released.

As water flows out of the tank, the water level 84 falls towards level B. As soon as the float moves through light beam 96, the light sensing element 102 emits a signal which is processed by the flip-flop circuit 114 to turn on the fluid pump 42 and to apply power to the delay circuit 130. After a short delay period, the delay circuit applies power to the relay which causes that relay to move from the closed to the open position. As soon as the relay opens, power is no longer applied to the coil 66, and the spring 70 moves the plunger back towards the tank bottom wall so the sealing element covers the tank outlet opening.

Water from the fluid pump 42 will be directed into conduit 120. However, this water is now also used to fill the toilet bowl 12 rather than only to fill the water tank 16. This result is achieved by a bowl filling system 136. While some of the water does enter the water tank, most of this water is used to fill the toilet bowl which has been emptied by the just-mentioned flush.

Figure 6:
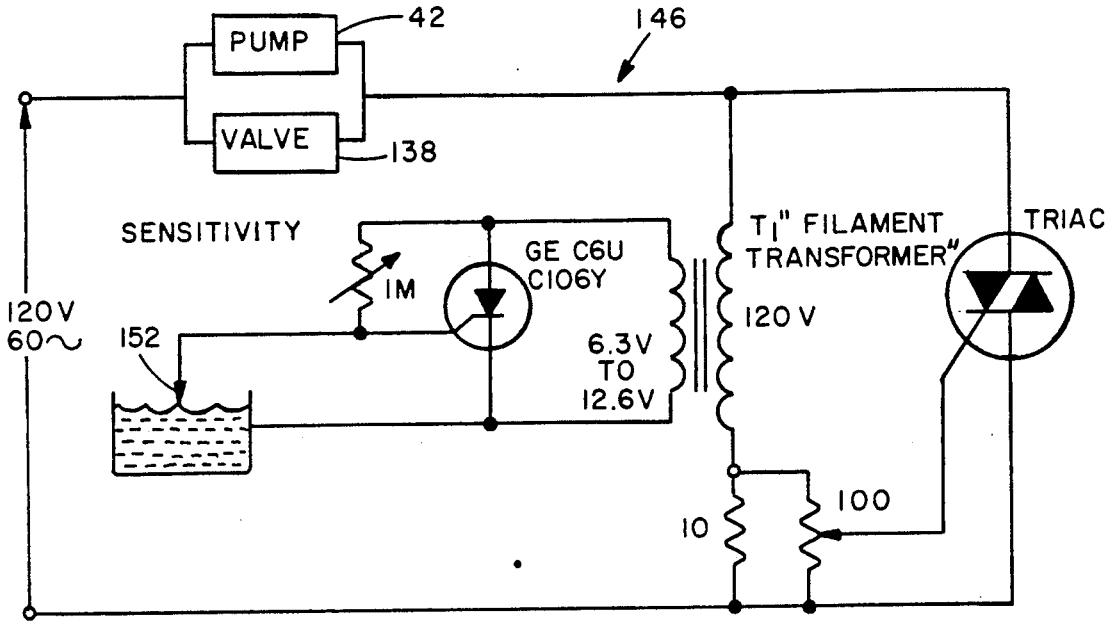
FIG. 6 is a circuit diagram illustrating a water level sensing control used in conjunction with the toilet bowl to deactivate the water pump used to fill the storage tank and the bowl.
Figure 7:
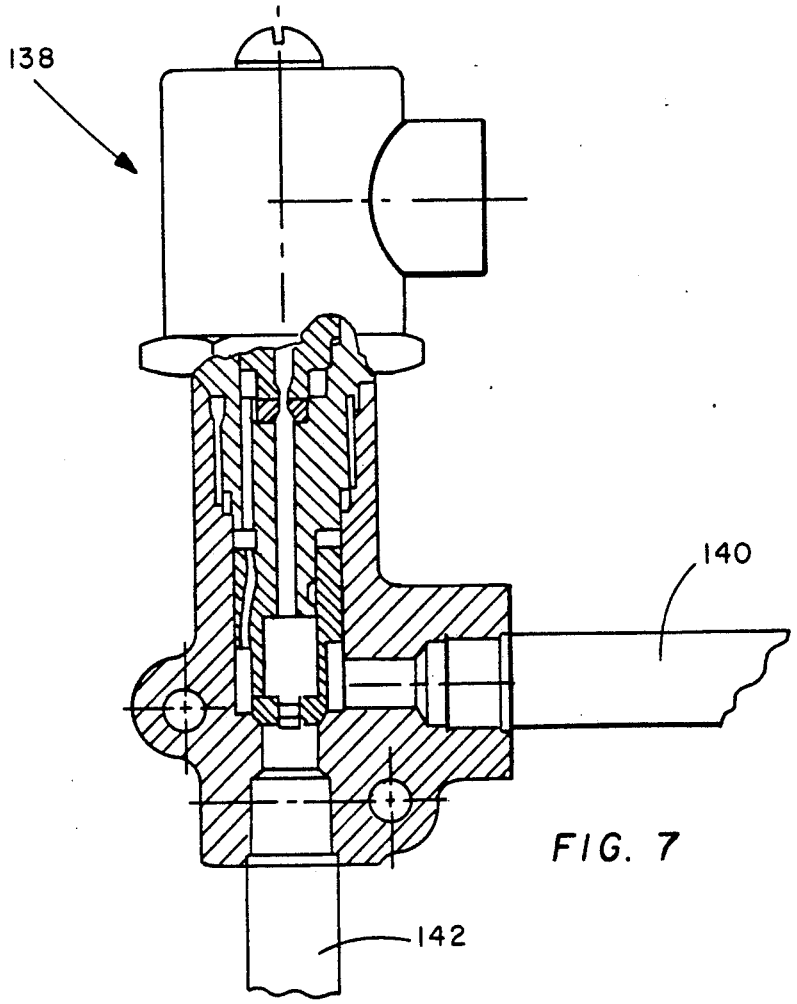
FIG. 7 illustrates a solenoid-controlled valve associated with the toilet bowl filling system of the present invention.

The bowl filling system 136 is shown in FIGS. 3, 6 and 7, and includes a solenoid-controlled valve 138 fluidically connected to the pump 42 by a conduit 140 and to the toilet bowl by a conduit 142 which is attached to a toilet bowl inlet port. Water from the pump 42 flows in directions 144 and 144' to fill the toilet bowl.

The toilet bowl includes a water level sensing circuit 146 which controls the solenoid-controlled valve 138 via line conductor 148 to cause that valve to close when the water level in the toilet bowl reaches a preset level, and to the pump to shut off that pump via a line conductor 150. The solenoid-controlled valve is set to close off the fluid connection between the fluid pump 42 and the toilet bowl when power is not applied to the solenoid-controlled valve, and to open the fluid connection between the fluid pump and the toilet bowl when power is applied to the solenoid-controlled valve. The circuit 146 is actuated by a signal from the buffer upon that buffer receiving the signal from the level B light sensing element 102. Power is applied to the solenoid-controlled valve and to the fluid pump until the water in the toilet bowl conducts through probe 152, and bypasses gate current from the low current SCR. This permits use of an isolated low voltage probe.

As soon as the water level in the toilet bowl is at the preset level, the solenoid-controlled valve 138 is closed, and the pump 42 is shut off since power is removed from both of these elements.

An additional line conductor 154 and circuit 156 also connects the fluid pump 42 to the plunger 58 to be sure that the fluid pump only operates after the plunger is in an outlet port covering position. The circuit 156 can be a relay which is connected to the relay 126 to be in exactly the opposite position to relay 126, or it can be a circuit similar to circuit 130, and can be used to prevent application of power to the fluid pump 42 until the plunger 58 is in position with the sealing element over the tank outlet port. The circuit 154 and 156 need not be used if it is not desired and can be used as a re-set circuit in the event of a system malfunction. A suitable "reset" button on the control panel 46 will activate this circuit when activated. Power for all circuits is received from utility power, and is conditioned by suitable transformers and the like.

Figure 8:
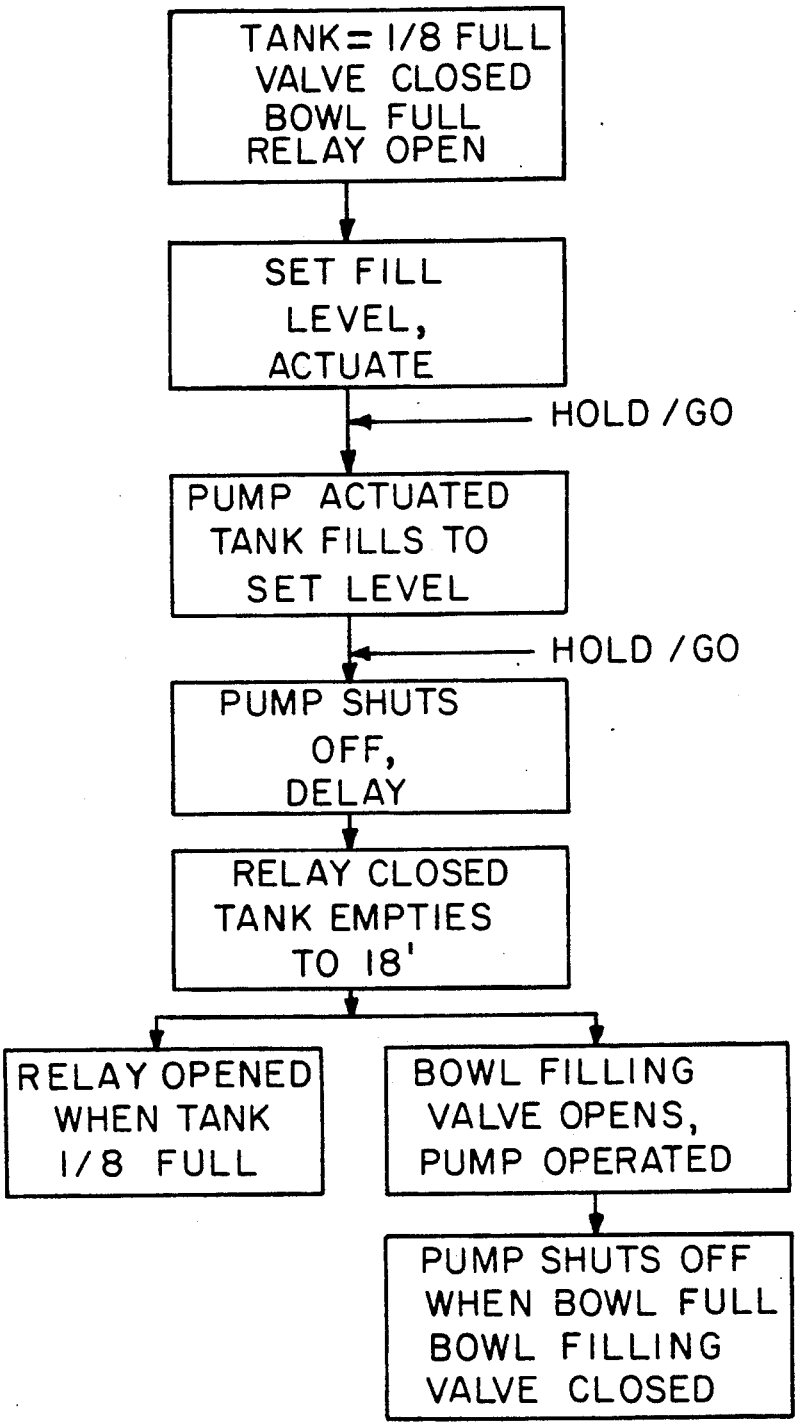
FIG. 8 is a block diagram illustrating the sequence of operation of the flush mechanism of the present invention.

Referring next to FIG. 8, a flush sequence is illustrated in block diagram form. The sequence begins with the tank nearly empty, or ⅛ full (the B level), the relay 126 is open, the plunger 58 is down so the sealing element covers the tank outlet port, the fluid pump 42 is off, the solenoid-controlled valve 138 is closed and the toilet bowl 12 is full. The user selects the level of water to be used, for example a full flush, and pushes the "on" button to initiate the flush sequence. The fluid pump 42 is activated by the pushing of the "on" button after the liquid fill level has been selected, and water is moved from the source 44 to the tank 16 bypassing the toilet bowl since the solenoid-controlled valve 138 is closed. When the level of water in the tank reaches the preselected level, level A, the float interrupts the light beam associated with that level, and the light sensing element 100 located at that level sends a signal to the buffer element 116, upon receiving a signal initiated by the low fluid level light sensing element, the buffer element signals the fluid pump to stop and applies power to the delay circuit 130. The delay circuit, after the preset delay period, applies power to the relay 126, which closes and applies power to the solenoid coil 66 to lift the plunger mounted sealing element from covering relation with the tank outlet port. The water passes into the syphon system associated with the full toilet bowl to flush that bowl.

The tank then empties to the lowermost level, level B, at which time the float interrupts light ray 96 and the light sensing element 102 emits a signal which is processed to turn on the fluid pump and to apply power to the delay circuit 130. After the preset time interval, power is again applied to the relay 126, which now opens to interrupt the application of power to the coil 66. This power interruption releases the plunger which now seats the sealing element 64 over the tank outlet port to close off the water tank from the toilet. The water tank is now at the lowest level.

The buffer element signal which is initiated by the light sensing element 102 is directed to the toilet bowl water level sensing circuit 146 which applies power to the solenoid-controlled valve 138 since water level in the toilet bowl is below the pre-set level. Such application of power opens the solenoid-controlled valve 138 and applies power to the fluid pump 42 to operate that pump. Operation of the fluid pump 42 directs water into the toilet bowl via the valve 138 and lines 140 and 142. When the toilet bowl has filled to the preset level, the sensor circuit 146 ceases applying power to the fluid pump 42, which shuts down that fluid pump, and ceases applying power to the solenoid-controlled valve 138 which shuts that valve.

In this condition, the water tank is empty (or at its lowest level, the B level), the plunger 58 has the sealing element 64 seated over the tank outlet port, the relay 126 is open, the fluid pump is off, the solenoid-controlled valve is closed and the toilet bowl is full, which is the above-mentioned starting condition. The sequence can be re-initiated by manual operation of the control panel 46.

The flushing sequence can be interrupted by activating the "hold" button which is connected to the fluid pump 42 and, when the "hold" button is depressed, power to the fluid pump 42 is interrupted. Power is restored to that pump by pushing the "go" button.

It is also noted that the process can be reversed and the system is capable of filling the storage or supply tank and discharging fractions as desired.

It is understood that while certain forms of the present invention have been illustrated and described herein, it is not to be limited to the specific forms or arrangements of parts described and shown.

I claim:

1. A fully automatic toilet comprising:

A) a toilet bowl having a fluid connection through which water flows into and out of said bowl;

B) a fresh water storage tank which is hollow and which includes (1) a bottom wall having an inner surface, (2) a front wall and a rear wall each having an inner surface, (3) two end walls each having an inner surface, (4) a top wall having an inner surface and an outer surface, (5) a water inlet port defined through said bottom wall, (6) a water outlet port defined through said bottom wall, and (7) said bottom wall sloping from said front and rear walls and from said end walls towards said outlet port;

C) a source of water;

D) water source connecting means connecting said source of water to said water storage tank, said water source connecting means including an electrically operated fluid pump connected to a power source;

E) valve means in said water storage tank for controlling flow of water from said storage tank into said conduit means, said valve means including (1) a support element fixed to the inner surface of said rear wall near said water outlet port, (2) a magnetic plunger having a top end located adjacent to said water storage tank top wall and a bottom end located adjacent to said water tank outlet port and being movably mounted on said support element to move from a first position with said bottom end located closely adjacent to said water storage tank outlet port to a second position with said bottom end spaced from said first position towards said water storage tank top wall, (3) a sealing element mounted on said plunger element bottom end to occludingly cover said water tank outlet port when said plunger is in said first position to prevent fluid connection between said water storage tank and said conduit means and to be spaced from said water tank outlet port to establish fluid connection between said water storage tank and said conduit means when said plunger is in said second position, and (4) plunger moving means mounted on said support element and including (a) a biasing means connected to said plunger and biasing said plunger towards said second position, and (b) a solenoid coil wrapped about said plunger and connected to said source of power to move said plunger against the bias of said biasing means from said second position to said first position when power is applied to said solenoid coil;

F) control means connected to said source of power and to said fluid pump and to said solenoid coil for selectively connecting and disconnecting said solenoid coil to said source of power and for selectively connecting and disconnecting said fluid pump to said source of power, said control circuit including (1) a control panel having (a) an "on" switch, (b) a "hold" switch, (c) a "go" switch, (d) a plurality of tank fill level setting switches which include (i) a full setting switch, and (ii) a ⅛ full setting switch, and (2) a full level control system which includes (a) a float inside said water storage tank, (b) a plurality of light emitting elements mounted on the inner surface of one of said end walls and each connected to one fill level setting switch of said control panel fill level setting switches and to said source of power to be activated when said one fill level setting switch is activated and including a full light emitting element located adjacent to said water storage tank top wall and connected to said "full" level setting switch and a ⅛ full light emitting element located adjacent to and spaced from said water storage tank bottom wall and connected to said ⅛ full setting switch, (c) a plurality of light sensing elements mounted on the inner surface of the other end wall to be co-level with corresponding light emitting elements of said plurality of light emitting elements and to receive light emitted by said light emitting elements and to emit a signal when light from said light emitting elements is incident thereupon, and (d) a circuit means connecting said light sensing elements to said power source and to said fluid pump and to said valve means solenoid coil to actuate said fluid pump and said valve means solenoid coil in accordance with signals from said light sensing elements.

2. The toilet defined in claim 1 wherein said control circuit means includes a delay circuit connected to said valve means solenoid coil.

3. The toilet defined in claim 2 wherein said delay circuit means includes a relay connecting said power source to said valve means solenoid coil.

4. The toilet defined in claim 3 wherein said control circuit means includes a buffer means and a flip-flop means.

5. The toilet defined in claim 4 wherein said control circuit means includes two comparator means.

6. The toilet defined in claim 5 wherein said control circuit means control panel "hold" and "go" switches are connected to said fluid pump.

7. The toilet defined in claim 6 wherein said delay circuit means connects said solenoid coil to said source of power to move said valve means plunger to said second position after said fluid pump has shut off.

8. The toilet defined in claim 7 further including a stop element mounted on said valve means support element adjacent to said valve means plunger top end.

9. The toilet defined in claim 8 wherein said biasing element includes a compression spring connected at one end thereof to said valve means stop element and at another end thereof to said valve means plunger top end.

10. The toilet defined in claim 9 wherein said control means further includes a water level sensing circuit means mounted on said toilet bowl to emit a signal when water in said bowl reaches a pre-set level.

11. The toilet defined in claim 10 wherein said control means further includes a fluid line fluidically connecting said fluid pump to said bowl, and a solenoid-controlled valve in said fluid line and connected to said bowl mounted water level sensing circuit to close when water in said bowl reaches said pre-set level.

12. The toilet defined in claim 11 wherein said fluid pump is connected to said bowl mounted water level sensing circuit to be shut off when water in said bowl reaches said pre-set level.

13. The toilet defined in claim 12 wherein said control means further includes means connecting said fluid pump to said valve means plunger to prevent starting said fluid pump until said valve means plunger moves into said second position.

14. The toilet defined in claim 13 wherein said fluid line-located solenoid-controlled valve is normally closed to prevent water from said fluid pump from moving into said toilet bowl, said fluid line-located solenoid-controlled valve being opened when said fluid pump is actuated by said storage tank mounted fill level control circuit means.

* * * * *